US005537784A

United States Patent [19]

Baldwin

[11] Patent Number: 5,537,784

[45] Date of Patent: Jul. 23, 1996

[54] INFLATABLE PORTABLE REFUGE STRUCTURE

[76] Inventor: Gary L. Baldwin, 415 S. 152nd Cir., Omaha, Nebr. 68154

[21] Appl. No.: 291,518

[22] Filed: Aug. 15, 1994

[51] Int. Cl.[6] ..... E04H 9/16

[52] U.S. Cl. ..... 52/2.17; 52/2.23; 52/63; 175/219

[58] Field of Search ..... 52/2.14, 2.17, 52/2.23, 63; 175/219

[56] References Cited

U.S. PATENT DOCUMENTS

| | | | |
|---|---|---|---|
| 2,910,994 | 11/1959 | Joy . | |
| 3,189,949 | 6/1965 | Hurkamp . | |
| 3,393,479 | 7/1968 | Slotnick . | |
| 3,497,606 | 2/1970 | Caminker et al. . | |
| 3,629,875 | 12/1971 | Dow et al. . | |
| 3,766,844 | 10/1973 | Donnelly et al. | 52/66 X |
| 3,857,209 | 12/1974 | Milliken | 52/2.17 |
| 4,442,162 | 4/1984 | Kuester | 428/245 |
| 4,707,953 | 11/1987 | Anderson et al. | 52/63 |
| 5,101,604 | 9/1992 | Wardlaw, III | 52/2.17 |

*Primary Examiner*—Carl D. Friedman

*Assistant Examiner*—Christopher T. Kent

*Attorney, Agent, or Firm*—Law Firm of John A. Beehner

[57] ABSTRACT

An inflatable portable refuge structure includes at least one refuge chamber having a floor, ceiling and a peripheral sidewall and an inner resealable entrance in the peripheral sidewall of the refuge chamber. An airlock chamber having a floor, ceiling and peripheral sidewall is connected to the refuge chamber adjacent the inner resealable entrance such that exiting from the refuge chamber through the inner resealable opening proceeds into the airlock chamber. The airlock chamber further includes an outer resealable entrance in the peripheral sidewall thereof. The refuge chamber and airlock chamber each further include at least one one-way pressure valve, the pressure valves operative to release air from within the chambers in response to increased air pressure within the chambers. An external pressurized air supply source spaced from the refuge structure and connected thereto by an air supply hose supplies uncontaminated air to the refuge chamber thereby inflating the refuge structure. The air supply source continuously supplies pressurized air to the refuge structure such that fresh air enters the refuge chamber and airlock chamber thereby forcing older air out of the chambers through the one-way pressure valves.

17 Claims, 3 Drawing Sheets

INFLATABLE PORTABLE REFUGE STRUCTURE

BACKGROUND OF THE INVENTION

1. Technical Field

This invention relates to inflatable refuge structures and, more particularly, to an inflatable portable refuge structure including a generally gas-impervious refuge chamber and an airlock chamber connected to the refuge chamber, an inner resealable entrance between the refuge chamber and airlock chamber and an outer resealable entrance in the airlock chamber, the refuge chamber and airlock chamber being inflated by a continuous source of pressurized air supplied from a remote, uncontaminated fresh air source, the refuge chamber and airlock chamber further including at least one one-way pressure valve to release air from within the chambers in response to increased air pressure within the chambers.

2. Description of the Prior Art

Among the many hazards found in the workplace are immediately dangerous to life and health (IDLH) atmospheres which are encountered in various occupations. Examples of situations in which an IDLH atmosphere may result include but are not limited to:

1) underground construction/mining;
2) confined space work;
3) hazardous material handling;
4) refineries that have accidental releases of toxic gases;
5) waste treatment plants with releases of toxic gases (such as hydrogen sulfide);
6) vehicle tunnels filled with smoke from an automobile accident; and
7) any other occupations where toxic fumes may be encountered.

While many of the above-described locations may or may not include devices such as respirators or the like which provide limited and temporary safety, there is a need for a portable refuge structure which is capable of providing more long-term protection for persons trying to escape IDLH atmospheres.

Two necessary elements for such a portable refuge structure are that the refuge structure be constructed for quick assembly and erection and that the refuge structure be supplied with uncontaminated air so that persons without respirators may breathe normally and those using respirators that expire and no longer provide protection may remove the respirators and breathe normally. Types of structures which may be quickly erected are inflatable enclosures which are supported by air pressure within the enclosure. Such enclosures are disclosed in Joy, U.S. Pat. No. 2,910,994, Wardlaw, III, U.S. Pat. No. 5,101,604, Caminker, et al., U.S. Pat. No. 3,497,606, and Slotnick, U.S. Pat. No. 3,393,479. Without exception, however, these inflatable enclosures are inflated by blowers which draw air from the area surrounding the inflatable enclosure and force the air within the inflatable enclosure. Clearly, if the inflatable enclosure is surrounded by an IDLH atmosphere, it is both dangerous and pointless to inflate the intended refuge enclosure with the same poisonous atmosphere. There is therefore a need for an inflatable enclosure which may be inflated by connection to an externally remote highly pressurized air source which will provide uncontaminated air.

Additionally, it is seen that some sort of inflating apparatus is necessarily included with each of the prior art devices disclosed above, the inflating device having to be carried around with the inflatable enclosure at all times. However, in many instances, the transportation of large blowers or the like is impractical and undesirable. There is therefore a need for an inflatable enclosure which may be inflated by connection to sources of highly pressurized air which are already present in the workplace area.

Furthermore, it is noted that each of the prior art enclosures cited above requires at least eight to ten minutes to inflate to a usable structure. In IDLH atmospheres, exposure of the body for such an extended period of time may prove harmful, even fatal. There is therefore a need for an inflatable portable refuge structure which may be quickly inflated, thus reducing exposure time of the body to the poisonous atmosphere.

Finally, it is noted that of those inflatable enclosures in the prior art which include airlocks, none of them show a single airlock connected to two or more refuge chambers. Such a feature may prove important when quarantine of one group of survivors is necessary. Furthermore, two chambers, one on each side of an airlock chamber, allows the airlock chamber to remain erect without internal or external rigid structural members. Additionally, having two chambers connected to a central airlock reduces contamination levels in any one chamber and allows for quicker fresh air purging from either chamber, instead of higher levels of contamination in one chamber. As a practical matter, in mining and tunnelling operations, standard crew size is 6–8 persons. A mine rescue team would normally include up to 5 persons. Prior art devices cannot provide for quarantine of a contaminated crew from the rescue team. There is therefore a need for such a structure which includes more than one refuge chamber.

Therefore, an object of the present invention is to provide an improved inflatable portable refuge structure.

Another object of the present invention is to provide an inflatable portable refuge structure having at least one refuge chamber to which is connected an airlock chamber, air being supplied to the two chambers by an uncontaminated pressurized air source remotely located from the refuge structure, and the refuge chamber and the airlock chamber further including at least one one-way pressure valve to release air from within the chambers in response to increased air pressure within the chambers and airlock.

Another object of the present invention is to provide an inflatable portable refuge structure which is inflated by connection to standard high pressure compressed air lines commonly found where pneumatic tools are used.

Another object of the present invention is to provide an inflatable portable refuge structure which includes an airlock chamber which is not supported by any rigid structural members.

Another object of the present invention is to provide an inflatable portable refuge structure which will constantly purge air from the interior of the structure through one-way valves in the structure thereby creating a self-purging effect.

Another object of the present invention is to provide an inflatable portable refuge structure which may be easily and quickly transported to a site having an IDLH atmosphere, quickly inflated and be supplied with uncontaminated air from a remote source.

Another object of the present invention is to provide an inflatable portable refuge structure having two or more chambers connected to a single airlock to allow for quarantine of a selected group of survivors or accommodation of a greater number of survivors.

Finally, an object of the present invention is to provide an inflatable portable refuge structure which provides a safe haven for persons needing shelter from an IDLH atmosphere over an extended period of time.

SUMMARY OF THE INVENTION

The present invention is designed to furnish a safe haven for refugees from IDLH atmospheres and over an extended period of time which should outlast commercially available respirators to do so with a minimal amount of difficulty.

The inflatable portable refuge structure of the present invention includes at least one refuge chamber having a floor, a ceiling and a peripheral sidewall, the sidewall interconnecting the floor and the ceiling such that a generally fluid-impervious chamber is formed. Each refuge chamber further includes an inner resealable entrance in the peripheral sidewall thereof. An airlock chamber includes a floor, a ceiling and a peripheral sidewall interconnecting the floor and ceiling, the airlock chamber connected to the refuge chamber adjacent the inner resealable entrance in the refuge chamber such that exiting from the refuge chamber through the inner resealable opening proceeds into the airlock chamber. The airlock chamber further includes an outer resealable entrance in the peripheral sidewall thereof. The refuge chamber and airlock chamber each further include at least one one-way pressure valve in at least one of the floor, ceiling and peripheral sidewall, the pressure valve operative to release gas from within the refuge and airlock chambers in response to increased gas pressure within the refuge and airlock chambers.

The structure is inflated by an external uncontaminated high-pressure air supply source spaced from the refuge structure and connected thereto by an air supply hose, the air supply source supplying uncontaminated air to the refuge structure thereby inflating the structure. The air supply source continuously supplies pressurized air to the refuge structure such that fresh air enters the refuge chamber and airlock chamber thereby pressurizing the chambers and forcing older/contaminated air out of the chambers through the one-way pressure vents. This pressurizing and fresh air purging creates a gas-impervious refuge chamber.

The present invention thus provides a portable inflatable refuge structure which is superior in many respects to those enclosure found in the prior art. Because the inflatable portable refuge structure is connected to an external pressurized air supply source which provides uncontaminated air, the refuge structure provides a safe haven for persons attempting to escape an IDLH atmosphere. Furthermore, because the structure is connected to a pressurized air source which continually supplies pressurized air, the air within the structure will not become stale. Furthermore, because of the constant purging of fresh air, any contaminated air that enters with persons entering the refuge will be ejected from the refuge and airlock chambers. Additionally, because the interior air pressure of the present invention is slightly greater than the external air pressure, poisonous gases in the external atmosphere are prevented from entering the inflatable refuge structure. Finally, because the present invention is inflated and supplied with air from already existing compressed air hoses, it is unnecessary to transport heavy and unwieldy inflating devices such as blowers with the inflatable portable refuge structure of the present invention. Therefore, wherever pneumatic tools and/or compressed air lines are used, the present invention may be inflated. As has thus been described, the present invention provides a substantial improvement over those inflatable enclosures found in the prior art.

DESCRIPTION OF THE PREFERRED EMBODIMENT

Figure 1:
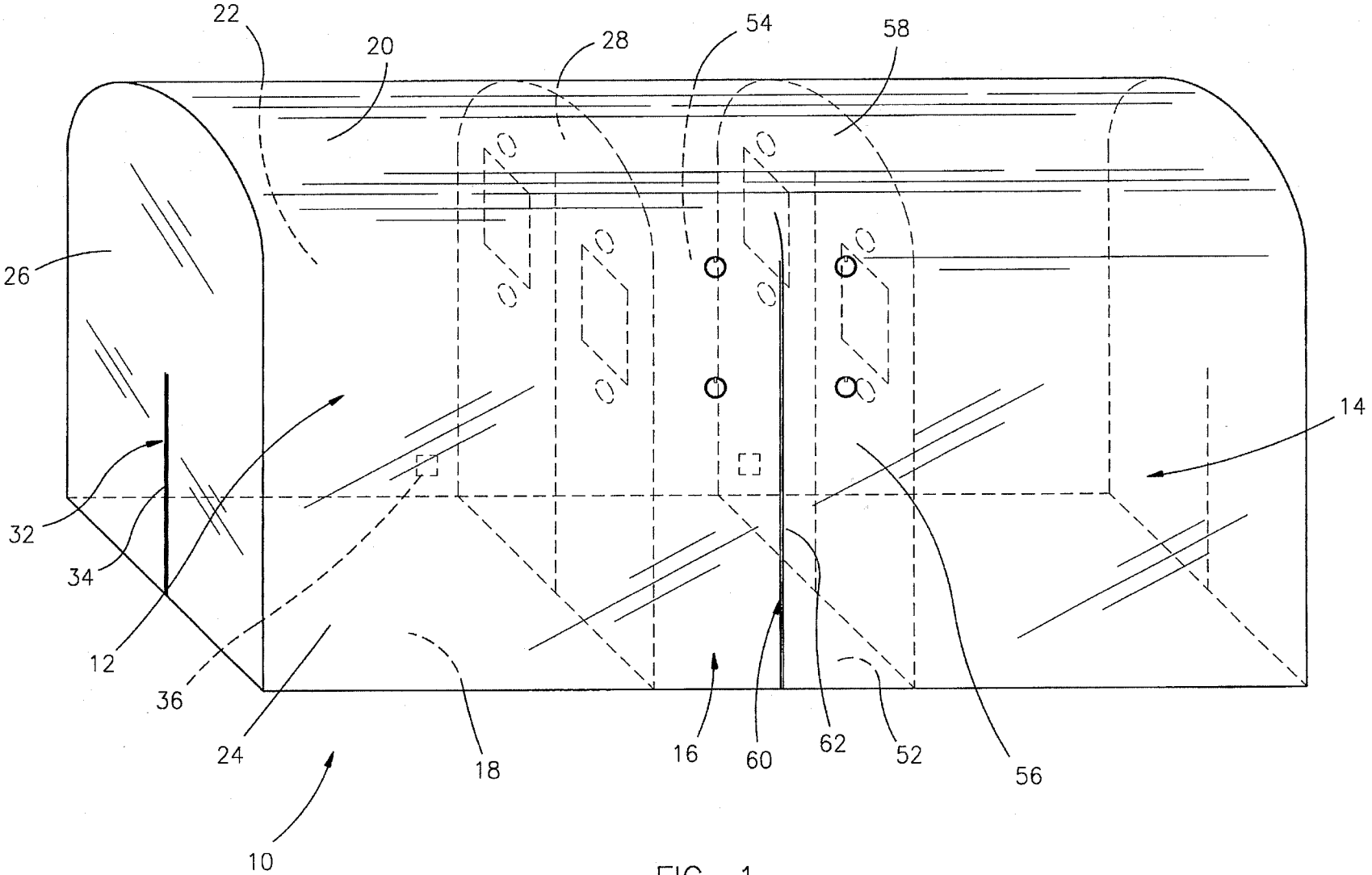
FIG. 1 is a perspective view of the inflatable portable refuge structure of the present invention.

The inflatable portable refuge structure 10 of the present invention is shown in its preferred embodiment in FIGS. 1–5 as including first and second refuge chambers 12 and 14 connected to one another by an airlock chamber 16. It is preferred that the first and second refuge chambers 12 and 14 be substantial mirror images of one another, and therefore the following description, while applying only to the first refuge chamber 12, should be understood to apply to the second refuge chamber 14, specifically regarding elements and features of the refuge chambers 12 and 14.

Figure 3:
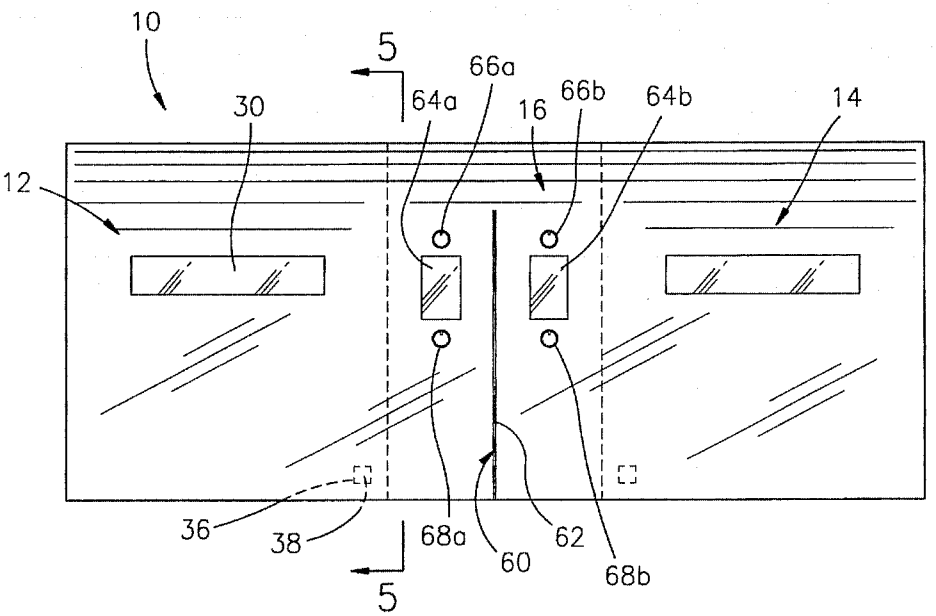
FIG. 3 is a side elevational view of the refuge structure.

The first refuge chamber 12 is best shown in FIGS. 1 and 3 as including a floor 18, ceiling 20, exterior walls 22 and 24, end wall 26 and resealable entrance wall 28. It is preferred that the floor be constructed of a sturdy nylon-based cloth of sufficient thickness to prevent accidental rips and tears caused by persons walking on the floor 18. It is preferred that the ceiling 20, exterior walls 22 and 24, end wall 26 and resealable entrance wall 28 all be constructed of a similar nylon-based cloth, but as the ceiling and walls need not support any weight or be especially tear-proof, the weight of the nylon-based cloth may be significantly less, in the neighborhood of seven ounces per square yard of material. The floor 18, ceiling 20, exterior walls 22 and 24, end wall 26 and resealable entrance wall 28 may be connected to each other by any suitable means such as thermal welding or stitching, so long as the seams formed are generally gas-impervious. It is further preferred that the nylon-based cloth used in construction of the refuge chamber 12 be coated such that the cloth is fire resistant and fluid resistant, both for increased safety and prevention of the formation of mildew while the refuge structure 10 is stored.

It is preferred that the exterior walls 22 and 24 be between 5 and 7 feet in height and be approximately 5–7 feet in width. It is also preferred that the end wall 26 and resealable entrance wall 28 have similar dimensions, those dimensions being approximately 6–8 feet in height at the midpoint of each wall 26 and 28, with the width of each wall being approximately 4–6 feet. Finally, it is preferred that ceiling 20 have a generally partial cylindrical shape, as shown best in FIG. 1. The resulting refuge chamber 12 is thus designed to accommodate approximately four people in relative comfort and would include an air volume of approximately 110 to 315 cubic feet. Therefore, the refuge structure 10 would accommodate approximately 8 persons in total.

As seen best in FIGS. 1 and 3, exterior walls 22 and 24 may include clear vinyl window panels 30 which allow for external viewing from the interior of the first refuge chamber 12. Such clear vinyl is commonly used in window applications where the window needs to be flexible, yet still retain fire-resistance and fluid-imperviousness. Although the clear vinyl window panels 30 are shown as generally rectangular in shape, it is to be understood that various shapes and sizes of window panels may be employed in the present invention.

End wall 26 further includes an emergency escape opening 32 which is preferably a vertical slot formed in the end wall 26 having a height of approximately 2 to 4 feet. The opening 32 is releasably secured in a closed position by fastener 34 which in a preferred embodiment would be a ridge and groove fastener which results in a gas-impervious seal on opening 32. Alternatively, the fastener 34 would consist of a toothless zipper which will prevent inward air leakage. In case of emergency, however, the ridge and groove fastener 34 may be quickly disengaged to allow for rapid exit from the refuge chamber 12.

Figure 4:
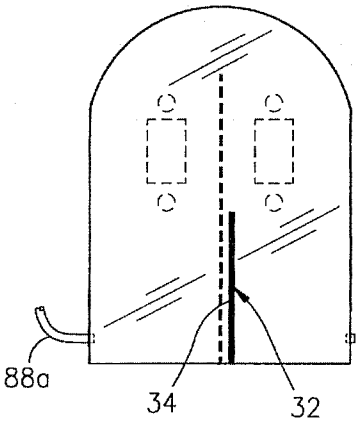
FIG. 4 an end elevational view of the refuge structure.

As best shown in FIGS. 1 and 4, exterior wall 22 would preferably include a reinforced patch 36 on which is mounted a compressed air supply hose connection member 38 to which a compressed air supply 88*a* hose 50 may be attached. In this manner, fresh air may be introduced directly into the first refuge chamber 12 as delivered by the compressed air supply hose 88*a*. Of course, patch 36 and connection member 38 may be placed at any location on the portable refuge structure 10, so long as the connection member 38 is capable of quickly and easily being attached to the compressed air supply hose 88*b* which, in turn, is connected to the main air supply line 50. It is preferred, however, that compressed air supply line 88*a* remain attached to connection member 38.

Figure 5:
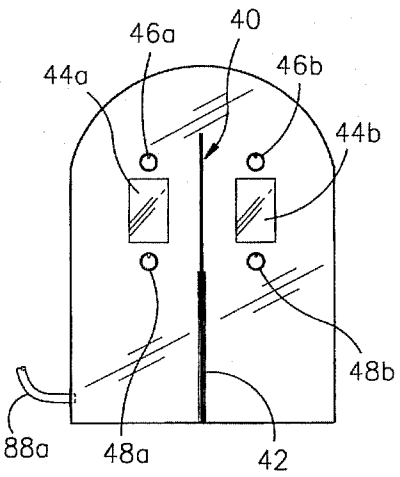
FIG. 5 is an end sectional elevational view of the refuge structure showing one of the resealable doors positioned between the airlock and refuge chambers.

FIGS. 1 and 5 best illustrate the resealable entrance wall 28 of the present invention. Entrance wall 28 would preferably include a generally vertical slit 40 extending from adjacent floor 18 to approximately one foot below the ceiling 20 with the overall length of slit 40 being approximately 5–7 feet. Closure of slit 40 may be accomplished by any suitable sealing means, however, it is preferred that slit 40 include a zipper 42 which extends the length of slit 40. Slit 40 may therefore be quickly and easily opened and closed. Because entrance wall 28 is flexible, opening of zipper 42 allows wall 28 to deform, thus allowing entrance into the first refuge chamber 12 by a person.

Also formed on the entrance wall 28 on each side of the slit 40 are two clear vinyl window panels 44*a* and 44*b* which allow viewing between the airlock chamber 16 and first refuge chamber 12. Of course, it is to be understood that windows 44*a* and 44*b* are not critical to the present invention, and may be changed, modified or not included as desired.

Figure 7:
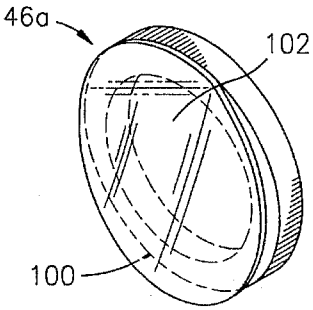
FIG. 7 is a partial detail view of one type of pressure valve.

Some of the most important features of the present invention are the one-way pressure valves 46*a*, 46*b*, 48*a*, and 48*b*, positioned above and below the window panels 44*a* and 44*b* and operative to vent air from the interior of the first refuge chamber 12 into the airlock chamber 16. It is preferred that the pressure valves 46*a*, 46*b*, 48*a* and 48*b* be conventional gas-pressure valves having a cracking pressure of approximately 0.25 psi. A preferred pressure valve would include a generally toroidal valve seat 100 on which is pivotally mounted a generally circular valve flap plate 102 having a diameter at least slightly greater than the inner diameter of valve seat 100, as best shown in FIG. 7. The center of the valve flap plate 102 is aligned with the center of the valve seat 100 such that valve flap plate 102 completely covers the inner circumference of the valve seat 100. The valve seat 100 and valve flap plate 102 are connected to each other along a section of the peripheral edge of valve flap plate 102 so that valve flap plate 102 is releasably secured against the valve seat 100 to prevent gas from passing through valve seat 100. Because the diameter of plate 102 is greater than the inner diameter of valve seat 100, each of the pressure valves are one-way valves. Air inside the structure 10 is released when the valve flap plate 102 deforms and is pushed away from valve seat 100. The pressure differential necessary to "crack" the valve is directly related to the rigidity of the material used to construct the valve flap plate 102, and thus it is preferred that valve flap plate 102 be constructed of a semirigid plastic which will deform upon application of a degree of force in the form of a pressure differential. It is preferred that this pressure differential be approximately 0.25 psi or 5" of water pressure. It is to be understood, however, that a variety of pressure valves could be substituted for the pressure valves described above, so long as the replacement pressure valve performs substantially the same function as the above-described valve. It is also to be understood that a different number of pressure valves may be used in the present invention, so long as at least two are provided between each of the first refuge chamber 12 and airlock chamber 16, second refuge chamber 14 and airlock chamber 16 and the airlock chamber and surrounding atmosphere. This is to insure that should one pressure valve become blocked or stuck for any reason, the remaining pressure valve may provide a safety factor to handle the air flow normally passing through both pressure valves. However, it is preferred that each resealable entrance wall 28 in the refuge chambers 12 and 14 include four (4) one-way pressure valves and that airlock chamber 16 include eight (8) one-way pressure valves to properly release air from within the structure 10.

The airlock chamber 16 preferably includes a floor 52, a rear wall 54, a front entrance wall 56 and a ceiling 58. It is preferred that the floor 52, rear wall 54, front entrance wall 56 and ceiling 58 interconnect the first and second refuge chambers and 14 such that a generally fluid-impervious chamber is formed between the refuge chambers 12 and 14 and substantially covering the entrance slit on each refuge chamber 12 and As shown best in FIGS. 1 and 3, front entrance wall 56 of the airlock chamber 16 includes a generally vertical slit 60 extending from adjacent floor 52 to approximately the top of front entrance wall 56. It is preferred that slit 60 be approximately 6 feet in height to allow for various size persons to fit therethrough. Similar to previously described slit 40 in resealable entrance wall 28, slit 60 further includes a zipper in the preferred embodiment, which allows slit 60 to be releasably sealed to prevent outflow of air from the interior of the airlock chamber 16. Front entrance wall 56 therefore functions similarly to entrance wall 28 as previously described.

Front entrance wall 56 would preferably further include a pair of clear vinyl window panels 64*a* and 64*b* formed on opposite sides of slit 60, as shown best in FIG. 3. It is preferred that window panels 64*a* and 64*b* be similar to window panels 44*a* and 44*b*, although, as was mentioned previously, the size, shape and number of window panels is not critical to the present invention. Finally, front entrance 56 includes two pairs of one-way pressure valves 66*a*, 66*b*, 68*a* and 68*b*, preferably formed above and below window panels 64*a* and 64*b*, although the pressure valves 66*a*, 66*b*, 68*a* and 68*b* may be placed anywhere on the front entrance wall It is preferred that one-way pressure valves 66*a*, 66*b*, 68*a* and 68*b* be substantially similar to the pressure valves 46*a*, 46*b*, 48*a* and 48*b* previously described in connection with entrance wall However, any suitable pressure valve may be substituted for the pressure valve described herein.

Alternatively, the structure 10 may remove the one-way pressure valves and instead merely use zippers which allow airflow between the teeth of the zippers. It is preferred, however, that the present invention include one-way pressure valves.

It is to be understood that the one-way pressure valves 46*a*, 46*b*, 48*a* and 48*b* in resealable entrance wall 28 of first refuge chamber 12 and one-way pressure valves 66*a*, 66*b*, 68*a* and 68*b* in front entrance wall 56 of airlock chamber 16 cooperate to release air from the interior of first refuge chamber 12 into the airlock chamber 16 and outwards to the exterior of the refuge structure These valves thus provide a purging effect which forces external toxic gases out of the refuge chambers 12 and 14 and airlock chamber 16 to the exterior of the refuge structure 10. When combined with a constant inflow of air through compressed air supply hoses 88*a* and 88*b*, it is seen that the present invention provides a unique method by which toxic gases are removed from the interior of the refuge structure 10.

Of course, rear wall 54 may include those features described in connection with front entrance wall 56 if so desired. It is preferred that the airlock chamber 16 be approximately 6–8 feet in height, 4–6 feet in width and 3–5 feet in length. Also, many changes and substitutions may be made to the shape, size and arrangement of the features described herein which still fall within the intended broad scope of the appended claims.

Figure 2:
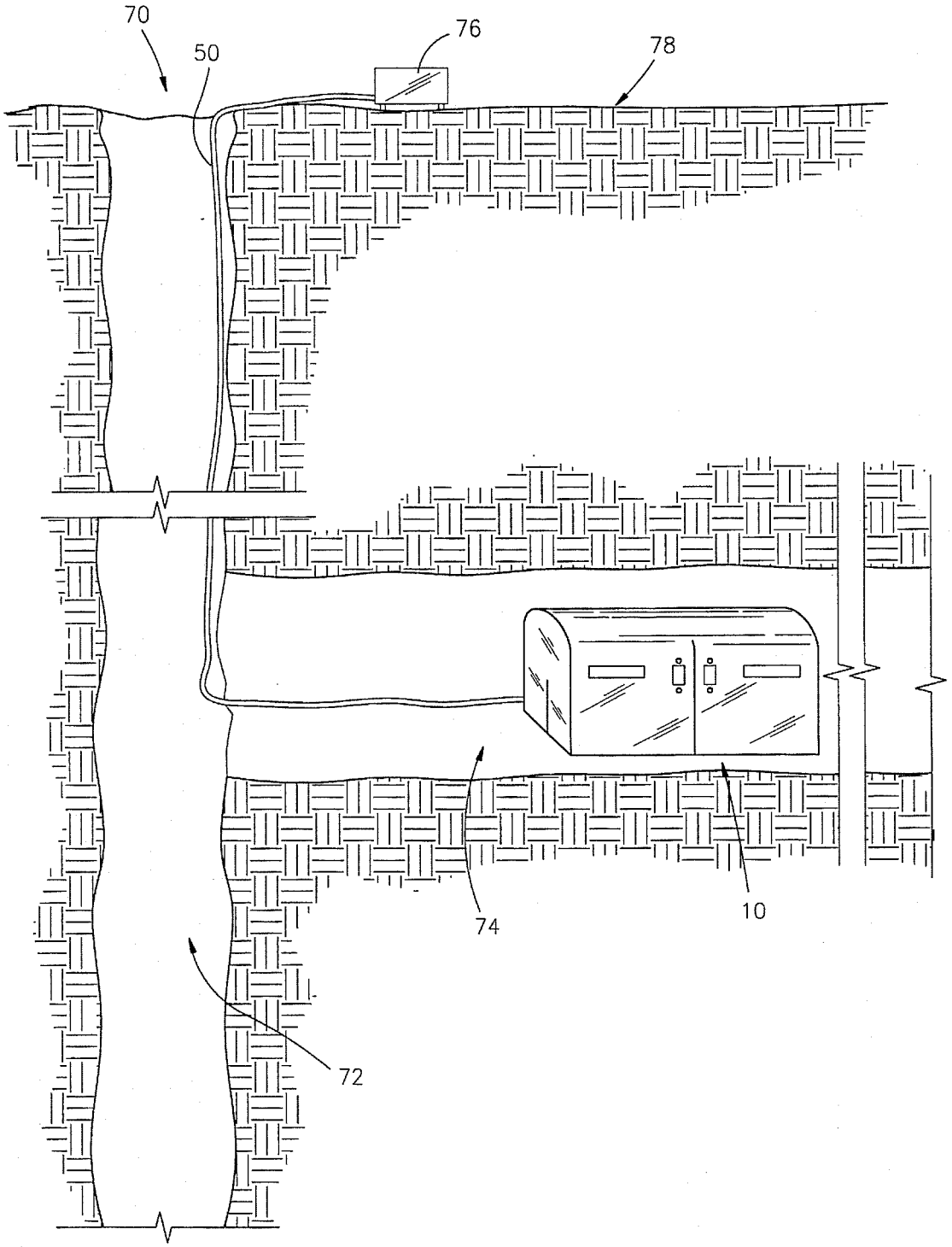
FIG. 2 is a side elevational view of the refuge structure within a confined space, showing the compressed air supply line extending to the surface and being connected to an air compressor above ground.

An example would best illustrate how the inflatable portable refuge structure 10 of the present invention is used. FIG. 2 is a side elevational view of a mine 70 which includes a shaft 72 and a tunnel 74 at the end of which mining operations are being conducted. A main air supply line 50 extends from a compressor 76 located on the surface 78 down into the mine 70 through shaft 72 and along tunnel 74. Mining crews typically consist of eight people and, as shown in FIG. 2, the crew working tunnel 74 has encountered toxic gases which cannot be removed by the ventilation system of the mine 70. As their respirators are only operative for a limited period of time and cannot supply oxygen, the inflatable portable refuge structure 10 of the present invention is the only means by which the crew will survive. As the total weight of the refuge structure 10 is approximately 35–45 pounds, including nylon-based cloth, valves, connection member, zippers and storage bag, the uninflated refuge structure 10 may be carried with the mining crew wherever they may go in the mine 70, or can be placed on the mine wall to be available if needed.

Figure 6:
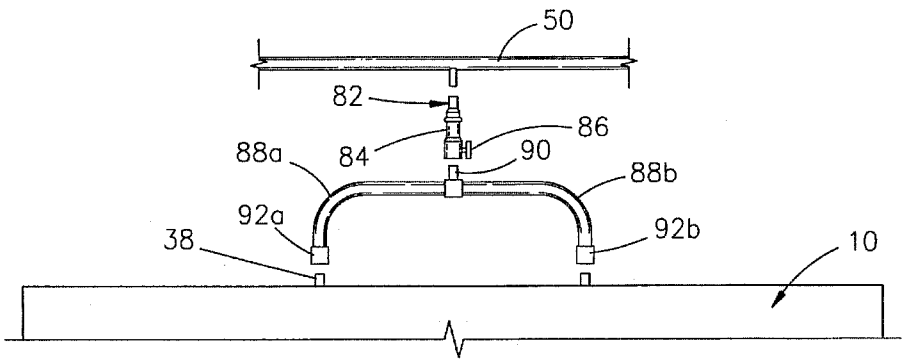
FIG. 6 is a partial detail top plan view of the rear of the refuge structure of the present invention.

To inflate the portable refuge structure 10, the crew would remove the refuge structure 10 from the storage bag or case and connect the connection end 82 of the flow valve 84 to the compressed air hose 50. Flow valve 84 may also be referred to as an orifice assembly. FIG. 68 shows that the flow valve 84 includes a hand-operated on/off lever 86 for adjusting air flow through the valve 84. Hoses 88*a* and 88*b* extend from a T-connector 90 to hose connectors 92*a* and 92*b* respectively. The opposite end of T-connector 90 is connected to flow valve 84. Hose connectors 92*a* and 92*b* are adapted to connect to the connection members 38 on the first and second refuge chambers 12 and 14. Flow valve 84 may be connected to air line 50 at a desired location prior to emergency, or may be connected when desired. If the flow valve 84 is already connected to the main air supply line 50, a user of the refuge structure 10 would then open the case to let the structure fall out of the case. As the flow valve 84 is already connected to main air supply line 50, all the user need do is turn on the on/off lever 86 thus allowing air to flow into the refuge structure Erection of the refuge structure is therefore even quicker, thus lessening exposure time of the crew to toxic gases. Of course, FIG. 6 displays the hose connection of the present invention in separated form to move clearly show the features therein, but it is understood that when the invention is being used, all hoses are connected together.

In many situations, the main air supply line 50 would be a 5"–8" air line formed of iron or steel. Such an air line 50 would normally deliver compressed air at approximately 120 psi at hundreds of cubic feet per minute. Flow valve 84 preferably includes a pressure orifice (not shown) which reduces the pressure of the air flowing into the structure 10. It is preferred that the pressure orifice reduce the incoming pressure from 120 psi to approximately 2–5 psi, and the rate of air from hundreds of cfm to 55–70 cfm. This flow rate meets the minimum flow rate established by the United States Bureau of Mines, which is 1.9 cfm per man within the structure 10.

The first refuge chamber 12 and second refuge chamber 14 would each inflate at the same time in approximately 3–4 minutes, quickly followed by the airlock chamber 16. An important feature of the present invention is that the structure 10 may be entered before it is fully inflated, because of the location of the airlock chamber 16 between the refuge chambers 12 and 14. Prolonged exposure to IDLH atmospheres is thus avoided. Of course, the speed at which the inflatable portable refuge structure 10 inflates is dependent upon the compressed air output through air line 50. The portable refuge structure 10 quickly assumes its fully inflated shape, as shown in FIGS. 1 and 2. Additionally, as the air being supplied through main air supply line 50 is uncontaminated by the toxic gases surrounding the refuge structure 10, the air within the refuge structure 10 is safe to breathe.

Once the portable refuge structure 10 is inflated, slit 60 in front entrance wall 56 may be opened by operating zipper 62 and thus crew members may enter airlock chamber 16. Slit 60 is then resealed by closing zipper 62 before operating zipper 42 thus opening slit 40 in entrance wall 28. Entrance to the first refuge chamber 12 may thus be gained. In a similar fashion, entrance to second refuge chamber 14 may be gained if such access if needed. During this time, main air supply line 50 has been constantly supplying compressed air to compressed air supply hose 88*a* and thus to first refuge chamber 12, thereby replacing air released when slit 60 and slit 40 were opened. It has been determined that opening of slit 40 will result in ceiling 20 and ceiling 58 dropping approximately 6 inches until pressure within first refuge chamber 12 and airlock chamber 16 is equalized. However, the portable refuge structure 10 will quickly reinflate to full size.

An advantage of the two refuge chambers 12 and 14 is that survivors of an incident may reside in one chamber 12 and the rescue team may be in the other chamber 14 recharging their self-contained breathing apparatus (SCBA) respirators. The Mine Safety and Health Administration (MSHA) regulates that a mine rescue teams must have a breathable air base every 1000' or the rescue team may not proceed down the mine, and the present invention fulfills that requirement.

Once all of the crew is safely housed within the portable refuge structure 10, the pressure valve feature of the present invention operates to keep the crew safe from the toxic gases external of the refuge structure 10. Air is constantly supplied by the main air supply line 50, thus building the pressure within first and second refuge chambers 12 and 14. Connection member 38 may also include a filter unit (not shown) to filter particulates and organic vapors from the compressed air coming from the compressor 76, to provide at least grade D air to the structure 10. The air pressure within first refuge chamber 16 reaches a certain point preferably approximately 0.25 psi greater than the pressure within the airlock chamber 16, at which pressure valves 46*a*, 46*b*, 48*a* and 48*b* crack open to release air into the airlock chamber Likewise, when air pressure within airlock chamber 16 reaches a certain level approximately 0.25 psi greater that the external air pressure, pressure valves 66*a*, 66*b*, 68*a* and 68*b* crack open to release air from within airlock chamber 16. The pressure within first refuge chamber 12, second refuge chamber 14 and airlock chamber 16 thus remains above the air pressure surrounding the portable refuge structure 10, thus effectively preventing toxic gases from entering the portable refuge structure 10. Also, when the various entrance walls 28 and 56 are opened, the resulting "blast" of air released acts to purge the chambers 12, 14 and 16 of any contaminants brought in by persons entering the structure 10. The crew may thus remove their respirators and wait out the event in relative safety and comfort.

Should the portable refuge structure 10 be accidentally breached, however, emergency escape opening 32 provides a quick and simple exit from the interior of the portable refuge structure 10. The fumbling and jamming of zippers 42 and 62 in event of emergency is thus prevented. It is thus seen that the portable inflatable refuge structure 10 of the present invention provides a quick and safe haven for crews in the event of a mishap or disaster.

It is to be understood that many modifications and substitutions may be made to the features described above which still fall within the intended broad scope of the appended claims. For example, the refuge structure 10 may be designed as a hemisphere structure divided into three separate chambers which would correspond to the first and second refuge chambers 12 and 14 and airlock chamber 16. Alternatively, the portable refuge structure 10 need only include a single refuge chamber connected to an airlock chamber, so long as the refuge chamber is constantly supplied with compressed air through a compressed air hose connected to a remote source for supplied uncontaminated air to the refuge structure 10.

The present invention therefore provides an inflatable portable refuge structure which accomplishes at least all of the stated objectives.

I claim:

1. An inflatable portable refuge structure comprising;

at least one frameless refuge chamber having a floor, a ceiling and a peripheral sidewall, said sidewall interconnecting said floor and said ceiling such that a generally fluid-impervious chamber is formed, said refuge chamber being free of a support frame;

an inner resealable entrance in said peripheral sidewall of said refuge chamber;

a frameless airlock chamber having a floor, a ceiling and a peripheral sidewall interconnecting said airlock chamber floor and said airlock chamber ceiling, said airlock chamber connected to said refuge chamber adjacent said inner resealable entrance in said refuge chamber such that exiting from said refuge chamber through said inner resealable opening proceeds into said airlock chamber, said airlock chamber being free of a support frame;

an outer resealable entrance in said peripheral sidewall of said airlock chamber;

said refuge chamber and said airlock chamber each further including at least one one-way pressure valve in at least one of said floor, ceiling and peripheral sidewall, said pressure valve operative to release gas from within said chambers in response to increased gas pressure within said chambers thereby purging said chambers of older/contaminated air;

an external pressurized air supply source comprising a compressor, spaced from said refuge structure and connected thereto by an air supply hose, said air supply compressor supplying uncontaminated air to said refuge chamber thereby inflating said refuge structure; and said air supply compressor operative to generally continuously supply pressurized air to said refuge structure such that said frameless refuge chamber and said frameless airlock chamber are inflatable in less than four minutes and are supported by pressurized air therein and further such that fresh air enters said refuge chamber and said airlock chamber thereby forcing older/contaminated air out of said chambers through said one-way pressure valves.

2. The inflatable portable refuge structure of claim 1 further comprising two refuge chambers each having a floor, a ceiling and a peripheral sidewall, said sidewall interconnecting said floor and said ceiling such that two generally gas-impervious chambers are formed, each of said refuge chambers including an inner resealable entrance in said peripheral sidewall of each of said refuge chambers.

3. The inflatable portable refuge structure of claim 2 wherein said airlock chamber extends between and is connected to each of said refuge chambers such that said inner resealable entrances of said refuge chambers aligned with said airlock chambers such that exiting from one of said refuge chambers through one of said aligned inner resealable entrances proceeds into said airlock chamber.

4. The inflatable portable refuge structure of claim 1 wherein said refuge chamber and said airlock chamber are constructed of a nylon-based cloth coated such that the cloth is fire resistant and fluid resistant.

5. The inflatable portable refuge structure of claim 1 wherein said refuge chamber and said airlock chamber each further comprise at least one translucent window for allowing external viewing and admitting light to the interior of said refuge chamber and said airlock chamber.

6. The inflatable portable refuge structure of claim 1 wherein said inner resealable entrance and said outer resealable entrance each comprise a generally vertical slit and zipper combination, said zipper operative to releasably seal said slit thus preventing substantial release of gas from within said refuge chamber and said airlock chamber.

7. The inflatable portable refuge structure of claim 1 wherein said refuge chamber further comprises an emergency escape opening including a generally vertical slit formed in said peripheral sidewall of said refuge chamber, said slit spaced from said inner resealable entrance, said slit further including a ridge and groove fastener for releasably sealing said slit.

8. The inflatable portable refuge structure of claim 1 wherein said one-way pressure valve comprises a generally toroidal valve seat having a center opening and a generally circular valve flap plate having a peripheral edge, said valve flap plate partially connected to said valve seat on the peripheral edge of said valve flap cover such that said valve flap plate covers and releasably seals said inner opening of said valve seat, said valve plate deforming and partially separating from said valve seat in response to increased fluid pressure on one side of said pressure valve.

9. The inflatable portable refuge structure of claim 1 wherein said refuge chamber comprises at least two one-way pressure valves in said peripheral sidewall such that gas within said refuge chamber may pass through said one-way pressure valves into said airlock chamber, yet air within said airlock chamber is prevented from entering said refuge chamber, said airlock chamber including at least two one-way pressure valves in said peripheral sidewall such that gas within said airlock chamber is released through said one-way pressure valves to the exterior of said refuge structure, while preventing external gases from entering said airlock chamber.

10. The inflatable portable refuge structure of claim 1 wherein said external pressurized air supply source comprises an air compressor unit.

11. The inflatable portable refuge structure of claim 1 wherein said refuge chamber further comprises at least one air hose connection member extending through said peripheral sidewall of said refuge chamber, said air hose connection member adapted to be connected to said air supply hose, said refuge chamber further including a reinforced patch mounted on said peripheral sidewall adjacent said air hose connection member to prevent accidental tearing of said peripheral sidewall when said air supply hose is connected to said air hose connection member.

12. The inflatable portable refuge structure of claim 1 wherein said external pressurized air supply source comprises a high-pressure compressed air source for pneumatic tools, said air supply hose comprising a pneumatic air hose connected to said high-pressure compressed air supply source for pneumatic tools.

13. An inflatable portable refuge structure comprising;

two frameless refuge chambers each having a floor, a ceiling and a peripheral sidewall, said sidewall interconnecting said floor and said ceiling such that two generally fluid-impervious chambers are formed, said refuge chambers being free of a support frame;

at least two inner resealable entrances, at least one in each peripheral sidewall of said refuge chambers;

a frameless airlock chamber having a floor, a ceiling and a peripheral sidewall interconnecting said airlock chamber floor and said airlock chamber ceiling, said airlock chamber extending between and connecting said two refuge chambers, at least one of said inner resealable entrances of each refuge chamber aligned with said airlock chamber such that exiting from one of said refuge chambers through one of said aligned inner resealable entrances proceeds into said airlock chamber, said airlock chamber being free of a support frame;

at least one outer resealable entrance in said peripheral sidewall of said airlock chamber;

said refuge chambers and said airlock chamber each further including at least one one-way pressure valve in at least one of said floor, ceiling and peripheral sidewall, said pressure valves operative to release gas from within said chambers in response to increased gas pressure within said chambers thereby purging said chambers of older/contaminated air;

an external pressurized air supply source comprising a compressor spaced from said refuge structure and connected thereto by an air supply hose, said air supply compressor operative to supply uncontaminated air to said refuge chambers thereby inflating said refuge structure; and said air supply compressor operative to supply pressurized air to said refuge structure such that said two frameless refuge chambers and said frameless airlock chamber are inflatable in less than four minutes and are supported by said pressurized air and further such that fresh air enters said refuge chambers and said airlock chamber thereby forcing older air out of said chambers through said one-way pressure valves for purging efficiency.

14. An inflatable portable refuge structure comprising;

a generally rectangular frameless box chamber having a floor, a ceiling and a peripheral sidewall interconnecting said floor and ceiling such that a generally fluid-impervious chamber is formed, said box chamber being free of a support frame;

said box chamber further including two spaced apart partition walls each extending between and connecting said floor, ceiling and peripheral sidewall such that said box chamber is divided into first, second and third subchambers;

two inner closable portals, one in each of said partition walls, such that passage between said first and second and said second and third subchambers is allowed;

an outer closable portal in said peripheral sidewall of said box chamber adjacent said second subchamber such that entrance to said second subchamber from the exterior of said refuge structure is allowed;

said box chamber further including at least one one-way pressure valve in at least one of said floor, ceiling, peripheral sidewall and partition walls, said at least one one-way pressure valve operative to release fluid from within said chamber in response to increased fluid pressure within said chamber; an external pressurized air supply source comprising a compressor spaced from said refuge structure and connected thereto by an air supply hose, said air supply compressor supplying uncontaminated air to said frameless box chamber thereby inflating said box chamber; and said air supply compressor being operative to generally continuously supply pressurized air to said box chamber such that said frameless box chamber is inflatable in less than four minutes and is supported by said pressurized air and further such that fresh air enters said box chamber thereby forcing older air out of said chamber through said at least one one-way pressure valve for purging efficiency.

15. An inflatable portable refuge comprising;

at least one frameless refuge chamber having a floor, a ceiling and a peripheral sidewall, said sidewall interconnecting said floor and said ceiling such that a generally fluid-impervious chamber is formed, said refuge chamber being free of a support frame;

an inner resealable entrance in said peripheral sidewall of said refuge chamber;

a frameless airlock chamber having a floor, a ceiling and a peripheral sidewall interconnecting said airlock chamber floor and said airlock chamber ceiling, said airlock chamber connected to said refuge chamber adjacent said inner resealable entrance such that exiting from said refuge chamber through said resealable opening proceeds into said airlock chamber, said airlock chamber being free of a support frame;

an outer resealable entrance in said peripheral sidewall of said airlock chamber;

said refuge chamber and said airlock chamber each further including internal pressure release means in at least one of said floor, ceiling and peripheral sidewall, said internal pressure release means operative to release gas from within said chambers in response to increased gas pressure within said chambers thereby purging said chambers of older/contaminated air;

an external pressurized air supply source comprising a compressor spaced from said refuge structure and connected thereto by an air supply hose, said air supply compressor supplying uncontaminated air to said refuge chamber thereby inflating said refuge structure; and said air supply compressor operative to generally continuously supply pressurized air to said refuge structure such that said frameless refuge chamber and said frameless airlock chamber are inflatable in less than four minutes and are supported by pressurized air therein and further such that fresh air enters said refuge chamber and said airlock chamber thereby forcing older/contaminated air out of said chambers through said internal pressure release means for purging efficiency.

16. The inflatable portable refuge structure of claim 15 wherein said inner resealable entrance and said outer resealable entrance each comprise a generally vertical slit and zipper combination, said zipper operative to releasably seal said slit thus preventing substantial release of gas from within said refuge chamber and said airlock chamber.

17. The inflatable portable refuge structure of claim 16 wherein said internal pressure release means comprises said zipper, said zipper operative to release small amounts of gas in response to increasing internal pressure within said refuge and airlock chambers.

* * * * *